US010689826B1

(12) United States Patent
Hardin

(10) Patent No.: US 10,689,826 B1
(45) Date of Patent: Jun. 23, 2020

(54) DIGGING BAR ATTACHMENT FOR TOOTHED BUCKET

(71) Applicant: Brandon Hardin, Walnut Springs, TX (US)

(72) Inventor: Brandon Hardin, Walnut Springs, TX (US)

( * ) Notice: Subject to any disclaimer, the term of this patent is extended or adjusted under 35 U.S.C. 154(b) by 0 days.

(21) Appl. No.: 16/116,529

(22) Filed: Aug. 29, 2018

(51) Int. Cl.
*E02F 3/96* (2006.01)
*E02F 3/40* (2006.01)

(52) U.S. Cl.
CPC ..... *E02F 3/40* (2013.01); *E02F 3/962* (2013.01)

(58) Field of Classification Search
CPC ..... E02F 3/962; E02F 3/8152
See application file for complete search history.

(56) References Cited

U.S. PATENT DOCUMENTS 3,043,032 A * 7/1962 Discenza ..... E02F 3/962 37/404
3,160,967 A * 12/1964 Nichols ..... E02F 3/8152 37/446
3,469,330 A 9/1969 Hood et al.
3,523,380 A 8/1970 Bolyard et al.
3,729,844 A * 5/1973 Deglan ..... E02F 3/401 37/408
3,765,109 A * 10/1973 Daviduke ..... E02F 3/401 37/449
3,942,271 A * 3/1976 George ..... E02F 3/40 37/404
4,009,529 A 3/1977 Johnson
4,043,060 A * 8/1977 Stepe ..... E02F 3/401 37/446
4,208,815 A * 6/1980 Yunker ..... E02F 9/2816 37/446
4,360,980 A * 11/1982 Jarvis ..... E02F 3/815 172/701.1
5,212,897 A 5/1993 Jefferson
5,253,449 A 10/1993 Webb et al.
5,596,825 A * 1/1997 Von Schalscha ..... E02F 3/8152 172/701.3
5,775,013 A * 7/1998 Von Schalscha ..... E02F 3/962 172/701.3
5,918,389 A 7/1999 Hall
6,070,345 A * 6/2000 Akaki ..... E02F 3/40 37/407
6,243,975 B1 6/2001 Gall
7,581,340 B2 9/2009 Wolfe
10,378,178 B2 * 8/2019 Andritzky ..... E02F 3/40

* cited by examiner

*Primary Examiner* — Matthew Troutman
(74) *Attorney, Agent, or Firm* — Law Office of Jeff Williams PLLC; J. Oliver Williams

(57) ABSTRACT

A digging attachment device for use with a toothed earth working bucket includes a contoured plate configured to be at least the width of the combined teeth of the bucket and extends over the ends of the teeth when seated. The device further includes a plurality of slots coupled to a lower surface of the plate. The slots are configured to accept the teeth of the bucket. The slots are tapered such that its internal distance within the slots relative to the lower surface of the plate progressively decreases to match the contour of the bucket teeth. The device further includes a fastener hole and fastener in communication with at least one of the plate and slots. The fastener is configured to be set within the countersink of the teeth fasteners. The device is secured without manipulation, adjustment, and removal of any portion of any earth working bucket.

18 Claims, 8 Drawing Sheets

DIGGING BAR ATTACHMENT FOR TOOTHED BUCKET

BACKGROUND

1. Field of the Invention

The present application relates to an attachment for an excavator bucket, and more particularly to a removable digging bar attachment device for coupling to the teeth of the excavator bucket.

2. Description of Related Art

Various types of large machinery use front or rear buckets for moving large amounts of earth at a time. The buckets are coupled to a mechanical arm that typically uses one or more hydraulic systems to actuate the bucket between forward and rearward positions. One type of bucket is shown in FIG. 1 and FIG. 2. The buckets have a relatively deep concave portion for scooping up dirt. A series of teeth 97 are located along a forward bottom surface of the bucket 99. As seen in FIGS. 1 and 2, the teeth are coupled to the bucket with fasteners that pass along axis 95. The fasteners may be a threaded fastener such as a screw. The head of the fasteners include a countersink area. The teeth help to puncture the ground and facilitate digging.

An issue that arises with these buckets is that they include teeth that are adapted nicely for digging without concern for what is underground, but are grossly inadequate for smoothing out an area or for digging in areas with utility lines hidden beneath ground level. Currently, the issue is with having teeth. The teeth can catch on underground cables, puncture water lines, along with other types of issues. Furthermore, the teeth prevent the bucket from being used to smooth out an area of dirt as the teeth are spaced. To correct for these deficiencies, operators are left with one of two options. Operators may swap buckets on the machinery to a bucket without teeth or they may weld on a bar to the teeth that eliminates the gaps between the teeth and effectively nullifies them.

Swapping buckets on large machinery is not a simple task and can result in lots of down time for the equipment. Additionally, this requires extra buckets to be hauled with and stored for potential use. Costs rise each time a bucket has to be switched. The other option also has some disadvantages. Although a simple plate is smaller than a bucket, downtime is still an issue. To weld on the plate, a welder is called out to the job site. Costs increase because of his/her time. When the tasks are finished, the plate can not be removed without sacrificing the teeth. The welder is called back out to cut off the teeth and new teeth have to be reattached to the existing bucket. Both methods result in lost time and increased costs.

Some solutions have been developed to try to correct for these problems. Most solutions complicate the problem by incorporating devices that surround the teeth but also wrap up the sides of bucket 99. Some designs use fasteners to compress the device onto the teeth but these can lose grip on the teeth and fall off. Others then wrap straps and connectors around the buckets to hold them in place. Most designs need a new type of bucket to operate with some sort of detachable attachment member. It is desired that a new type of attachment device is developed that firmly couples to the teeth of a conventional toothed bucket and does not cover or couple to the bucket. The attachment should be adaptable and scalable for use with buckets of different sizes.

Although strides have been made to make toothed machinery buckets more versatile for digging conditions, shortcomings remain.

SUMMARY OF THE INVENTION

It is an object of the present application to provide a digging bar attachment device for use with toothed machinery buckets that is configured to fit around the teeth of the bucket and releasably couple to the teeth via existing fastener holes. The device is configured to provide a strait edge for the bucket when digging. The strait edge may also be used for smoothing or leveling dirt. The device is configured to cover the teeth only and avoid contact with any portion of the bucket.

It is a further object of the present application that the device includes a fastener hole and a fastener. The fastener hole is aligned with the fastener used for the teeth when positioned on the bucket. The fastener is configured to secure the device by passing into the countersink of the teeth fastener. This helps to align the device with the teeth. In this manner, the device is fully secured to the teeth without welding or coupling to the bucket itself. It is understood that the teeth may be secured from an upper surface or through a side surface accessible between the teeth. The fastener hole and fastener of the device may be located either across a top surface of the plate or through a side surface of a tooth slot.

The device is configured to include a plurality of tooth slots configured to have a hollowed center. The teeth of the bucket are configured to pass through its respective tooth slot. The plate of the device is configured to extend beyond the end of the teeth. The tooth slots are configured to restrict movement of the device about the teeth and the fasteners are configured to maintain the plate in a seated position on the teeth.

The method of using the device is simplified in that an operator only needs to slide the device over the teeth, wherein the teeth slide through the tooth slots. The fasteners are then rotated into the countersink area of the teeth fasteners and tightened. Use of this device avoids the need to replace the bucket, use a modified specialty bucket, or sacrifice the teeth via welding. Ultimately the invention may take many embodiments. In these ways, this device overcomes the disadvantages inherent in the prior art.

The more important features of the assembly have thus been outlined in order that the more detailed description that follows may be better understood and to ensure that the present contribution to the art is appreciated. Additional features of the device will be described hereinafter and will form the subject matter of the claims that follow.

Many objects of the present device will appear from the following description and appended claims, reference being made to the accompanying drawings forming a part of this specification wherein like reference characters designate corresponding parts in the several views.

Before explaining at least one embodiment of the device in detail, it is to be understood that the device is not limited in its application to the details of construction and the arrangements of the components set forth in the following description or illustrated in the drawings. The device is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the various purposes of the present device. It is important, therefore, that the claims be regarded as including such equivalent constructions insofar as they do not depart from the spirit and scope of the present device.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
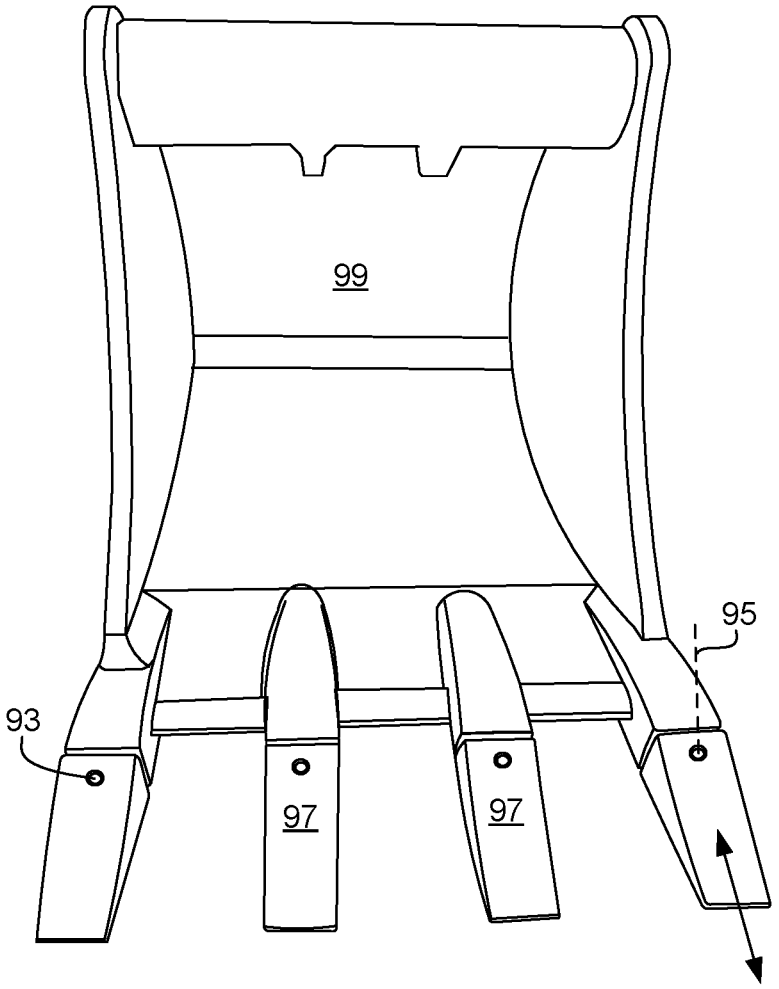
FIG. 1 (Prior Art)
FIG. 1 is a front view of an excavator bucket.
Figure 2:
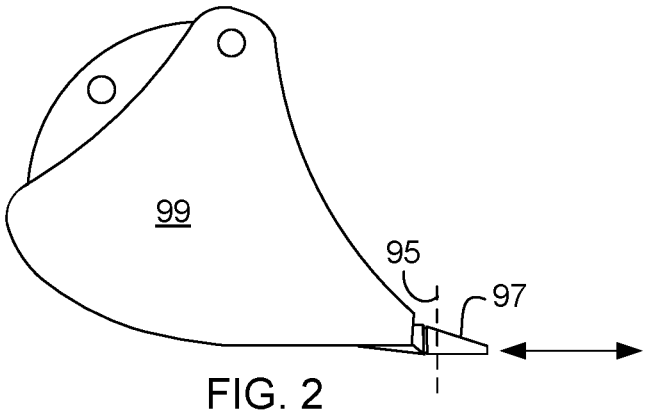
FIG. 2 (Prior Art)
FIG. 2 is a side view of the excavator bucket of FIG. 1.

While the device and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the assembly described herein may be oriented in any desired direction.

The device and method in accordance with the present application overcomes one or more of the above-discussed problems commonly associated with toothed machinery buckets and conventional advancements. In particular, the device is configured to slide around the teeth of the bucket such that the device seats against the teeth. The device is configured to couple to the teeth via one or more fasteners. The fasteners are configured to pass into the counter sink of the teeth fasteners. The device is aligned with the teeth and is configured to cover the teeth without further attachment to the bucket. The device operates with conventional buckets and is detachable without harm or manipulation to the teeth or the bucket. These and other unique features of the assembly are discussed below and illustrated in the accompanying drawings.

The device and method will be understood, both as to its structure and operation, from the accompanying drawings, taken in conjunction with the accompanying description. Several embodiments of the device may be presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

The device and method of the present application is illustrated in the associated drawings. The device includes a contoured plate configured to be at least the width of the combined teeth and to extend over the ends of the teeth when seated. The device further includes a plurality of slots coupled to a lower surface of the plate. The slots are configured to accept the teeth of the bucket. The slots are tapered such that their internal distance within the slots relative to the lower surface of the plate progressively decreases to match the contour of the bucket teeth. The device further includes a fastener hole and fastener in communication with at least one of the plate and the slots. The fastener configured to be set within the countersink of the teeth fasteners. Additional features and functions of the device are illustrated and discussed below.

Referring now to the Figures wherein like reference characters identify corresponding or similar elements in form and function throughout the several views. The following Figures describe the device of the present application and its associated features. With reference now to the Figures, an embodiment of the digging attachment device and method of use are herein described. It should be noted that the articles "a", "an", and "the", as used in this specification, include plural referents unless the content clearly dictates otherwise.

Figure 3:
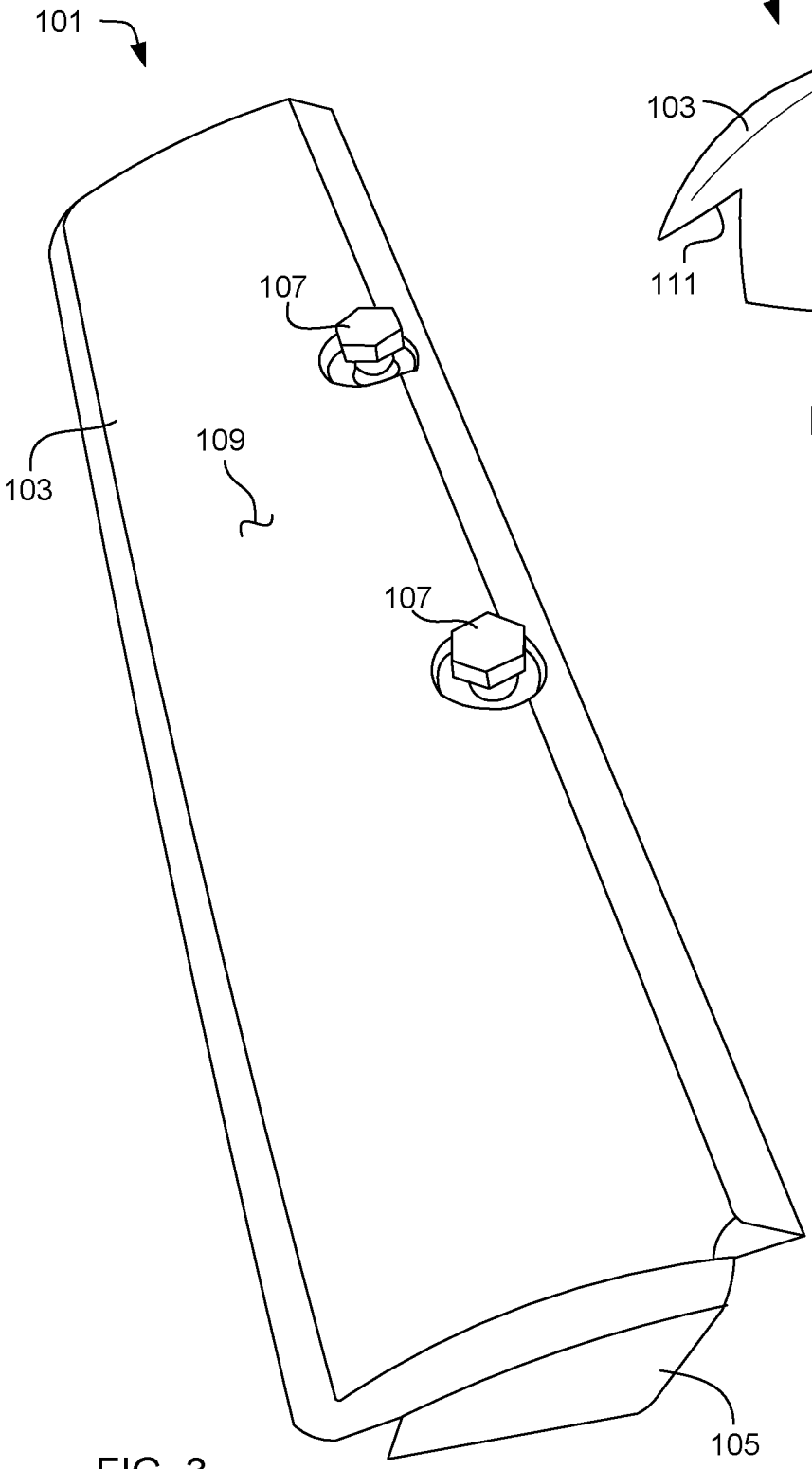
FIG. 3 is a perspective view of a digging attachment device according to an embodiment of the present application.

Referring now to FIG. 3 in the drawings, a perspective view of a digging attachment device is illustrated. Digging attachment device 101 is configured to work with an earth wording bucket 99 (i.e. an excavator bucket) that includes a plurality of teeth 97. These buckets are used to primarily dig the earth. Device 101 includes a plate 103, a plurality of slots 105, and a fastener 107. Plate 103 has a generally rectangular shape with a top surface 109 and a lower surface 111. The plurality of slots 105 is coupled to the lower surface 111. The plurality of slots 105 is configured to pass around the plurality of teeth 97. Fastener 107 is configured to engage the tooth fastener 93 and align the plate 103 relative to the teeth 97. Fastener 107 is in removable contact with the tooth fastener 93.

Figure 4:
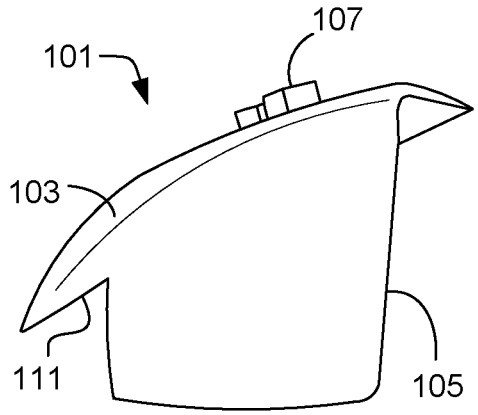
FIG. 4 is a side view of the digging attachment device of FIG. 3.

Referring now also to FIG. 4 in the drawings, a side view of device 101 is provided. Plate 103 rests above slots 105. Plate 103 is configured to include a slight dome shape such that the thickest part of plate 103 tends to be at the center portion while the thinnest portion is around its perimeter. The rounded contour helps to avoid edges which can work to impede the performance of device 101.

Referring now also to FIGS. 5-8 in the drawings, various views of device 101 are provided. As seen clearly in the views, slots 105 extend from lower surface 111. Slots 105 are formed by the inclusion of two opposing side walls 113 and a lower member 115. Slots 105 define an interior volume as a space between walls 113, lower member 115 and lower surface 111. Lower surface 111 is continuous for the length and width of plate 103. By not including an upper member opposite lower member 115, a lip is prevented which could potentially catch on teeth 97 when being inserted. Also, plate 103 is able to directly contact teeth 97 along lower surface 111. The loads exerted upon to surface 109 when in use can be large. By contacting teeth 97 directly to plate 103, the full length of teeth 97 can be used to absorb loads as opposed to only the portion contacting the slot.

As further seen in the figures, lower member 115 is angled relative to lower surface 111. Therefore, slots 105 are angled relative to plate 103. Walls 113 are irregularly shaped (not rectangular). The distance between lower surface 111 and lower member 115 changes along the length of slot 105. The distance is shortest at front edge 117 and longest at rear edge 119 (see FIG. 7).

Figure 5:
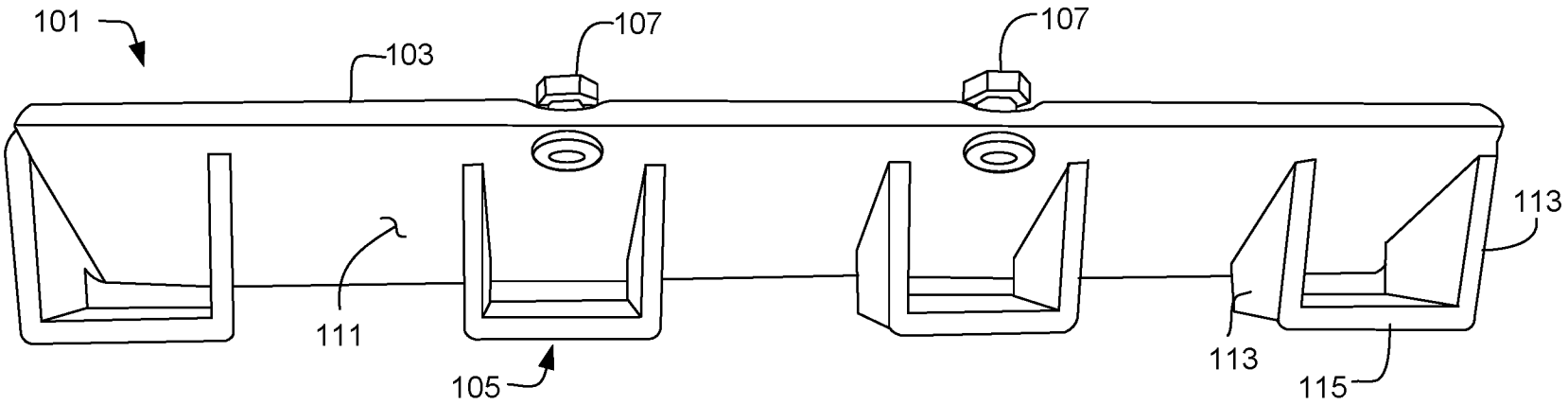
FIG. 5 is a rear view of the digging attachment device of FIG. 3.
Figure 6:
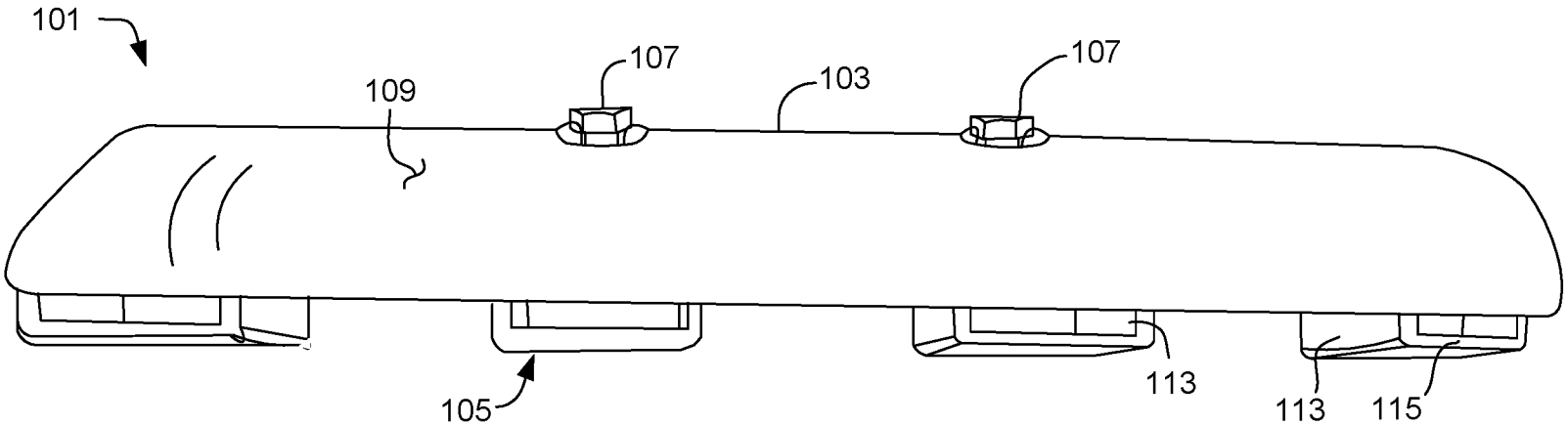
FIG. 6 is a front view of the digging attachment device of FIG. 3.
Figure 7:
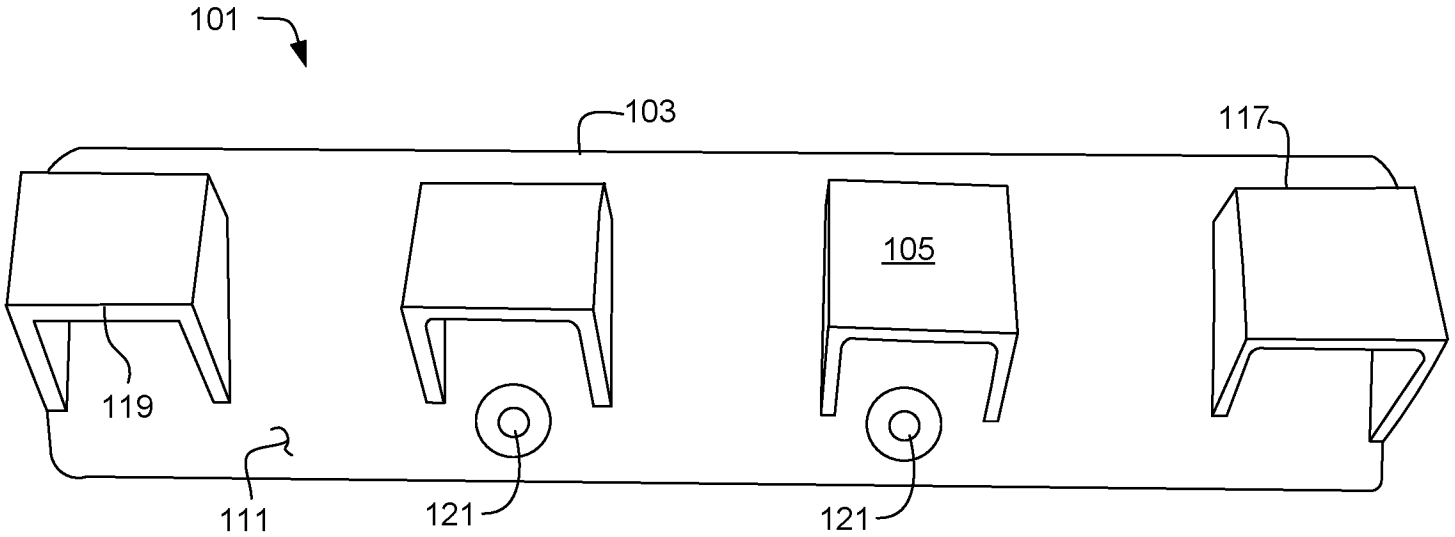
FIG. 7 is a bottom view of the digging attachment device of FIG. 3.
Figure 8:
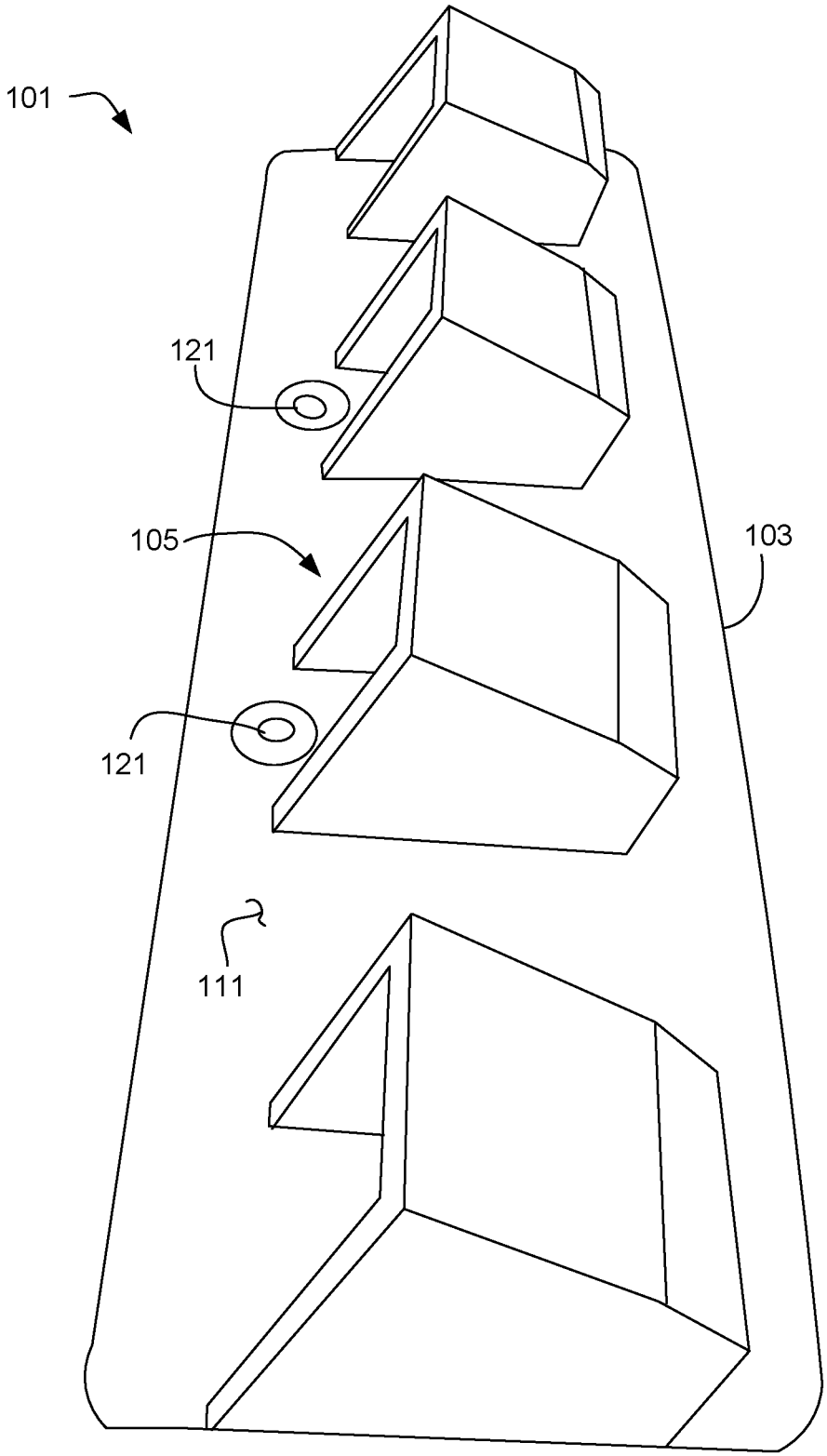
FIG. 8 is a lower perspective view of the digging attachment device of FIG. 3.

In particular with FIGS. 5 and 6, fastener 107 is seen in communication with plate 103. Fastener 107 is configured to pass through an fastener hole 121. Aperture 121 is seen well in FIGS. 7 and 8 of the drawings. Fastener 107 is threaded at least partially along its length to permit for the selective translation relative to plate 103. When device 101 is seated about teeth 97, fastener hole 121 is aligned with axis 95, such that fastener 107 translates along axis 97 when operated. Fastener 107 is recessed within plate 103 such that the head of fastener 107 is equal to or below the contoured surface of top surface 109.

It is understood that front edge 117 and rear edge 119 are set back from the perimeter of plate 103. Slots 105 are aligned and spaced equally to that of teeth 97. As seen in the Figures, the outer most slots 105 are used to define the outer perimeter of plate 103. Plate 103 may optionally extend outward beyond walls 113 of the outer slots in other embodiments.

Figure 9:
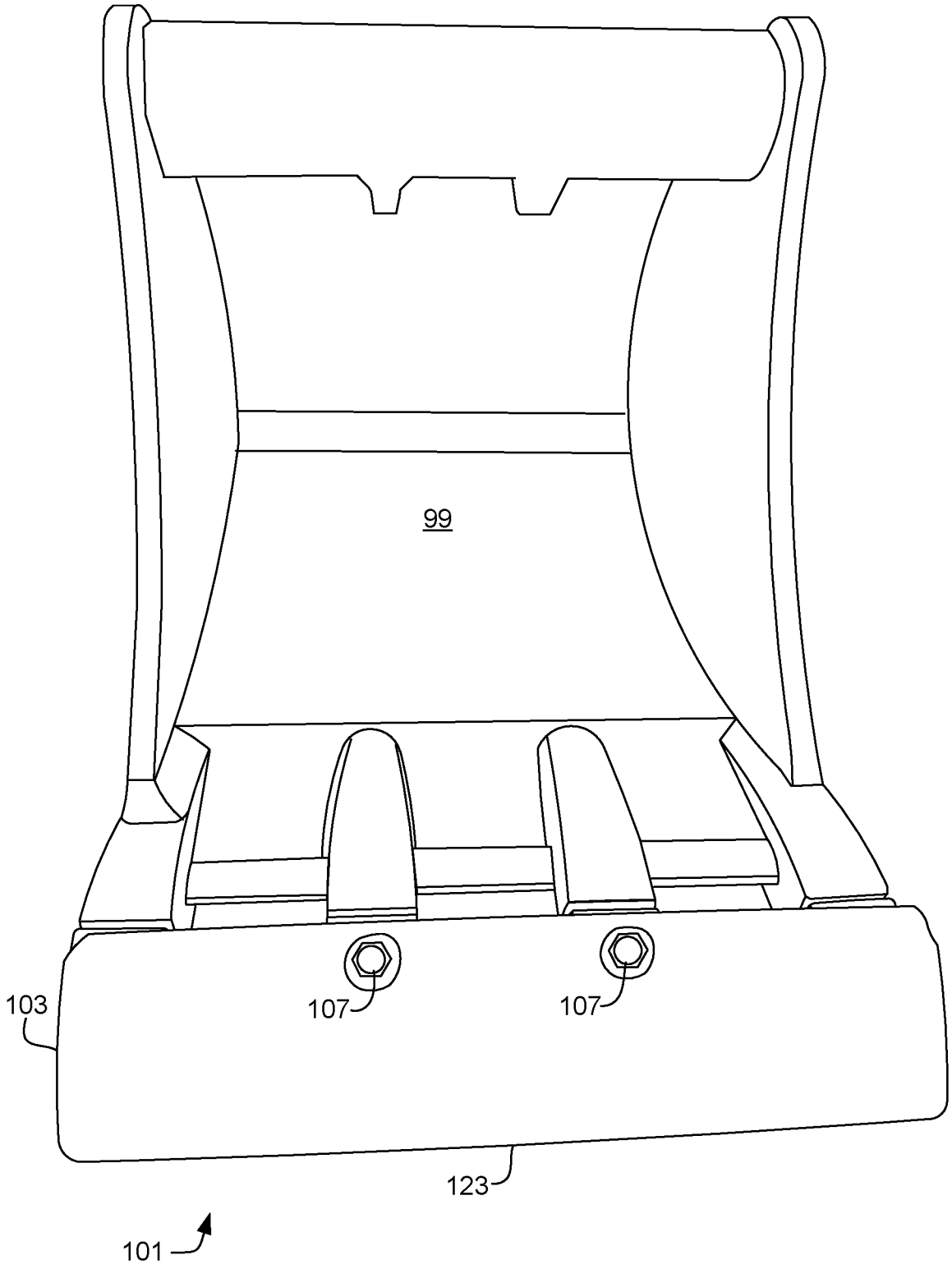
FIG. 9 is a top view of the digging attachment device coupled to the bucket of FIG. 1.
Figure 10:
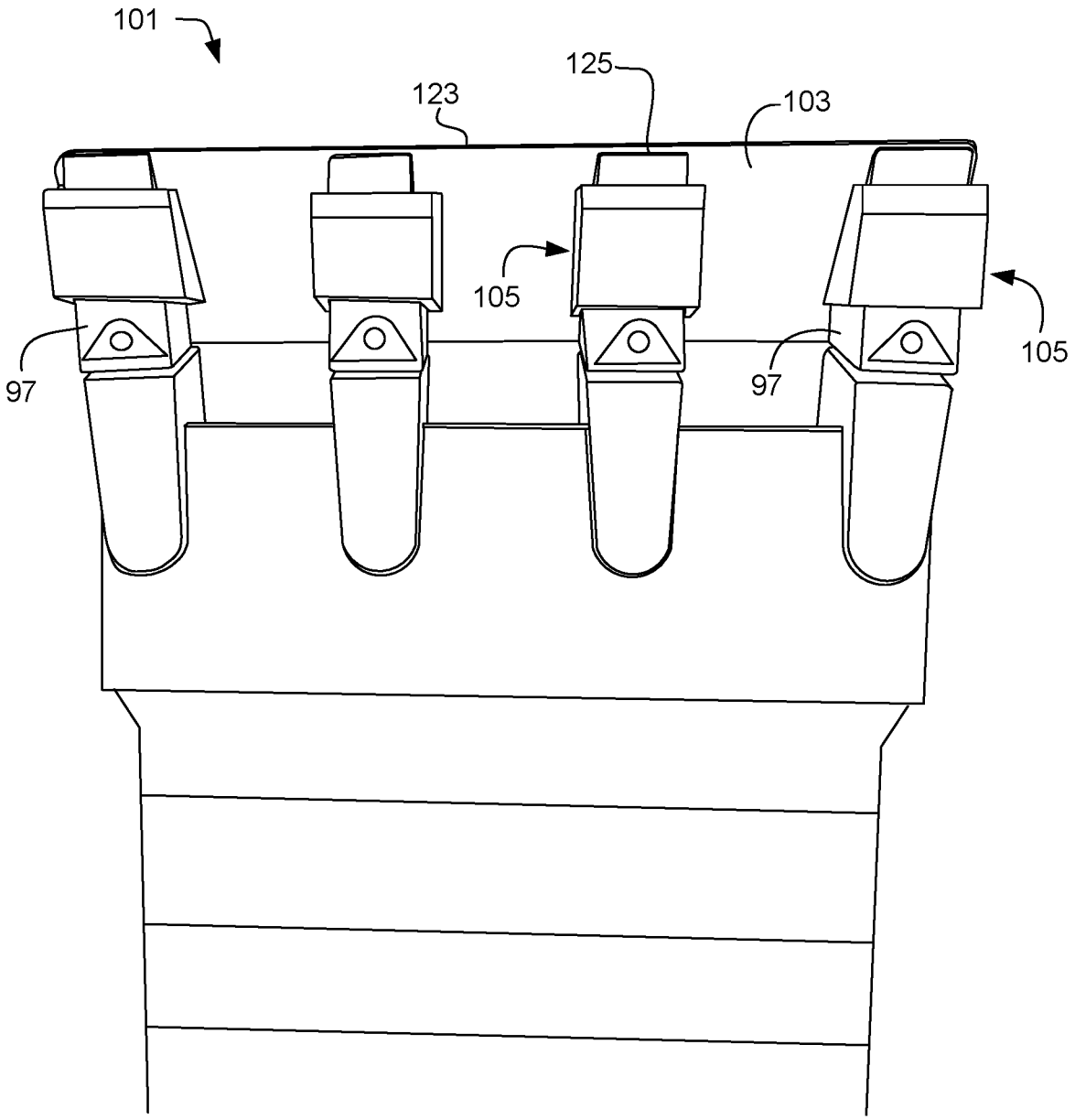
FIG. 10 is a bottom view of the digging attachment device of FIG. 9.

Referring now also to FIGS. 9 and 10 in the drawings, a top and bottom view of device 101 is illustrated on bucket 99. Device 101 is configured to translate over teeth 97 and be selectively secured through engagement with teeth fastener 93. As seen clearly in FIG. 10 of the drawings, teeth 97 pass within the interior volume of slots 105. The angle of slots 105, and in particular with lower member 115, are such as to match the taper of teeth 97. As teeth 97 are inserted, lower surface 111 and slot 105 is configured to make contact with the perimeter surfaces of teeth 97. This "full" contacting ensures a complete and well distributed load transfer between plate 103 and teeth 97. Slots 105 help to ensure that plate 103 does not shift in any direction during use.

In use, device 101 is translated onto teeth 97 of the bucket 99. Slots 105 are aligned with teeth 97. Translation continues until teeth 97 are fully seated into slots 105 (i.e. full contact) wherein the slots contact the perimeter of teeth 97. Further aligning is performed by operation of fasteners 107. As fasteners 107 are selectively operated, fasteners 107 engage teeth fasteners 97 and in particular pass within the countersunk surface portion of the teeth fasteners. No portion of the teeth 97 or its fasteners are required to be adjusted, manipulated, or removed. Passage of fasteners 107 into the countersunk surface portion of teeth fasteners 93 provide resistance for removal of device 101 by sliding off teeth 97. When bucket 99 is in use, pressure will be predominantly applied against lower edge 123 in a direction inward to the bucket. The tapered or angled relationship of plate 103 and slots 105 with respect to teeth 97 is designed to absorb those forces. Fasteners 107 are configured to predominantly absorb the opposing forces directed outward from the bucket 99. It should be noted also that engaging fasteners 107 into the countersunk surface portion also provides a lifting force to plate 103 to ensure that plate 103 is aligned with teeth 97 in case of potential slop in the mating or seating process. Removal of device 101 is done by merely loosening fasteners 107 by backing them out from the countersunk surface portion and pulling it away from teeth 97.

It is understood that plate 103 extends beyond the collective perimeter of teeth 97 and provides a strait lower edge 123. As seen in FIG. 10, plate 103 extends beyond a distal end 125 of teeth 97. It should be further understood that any number of fasteners 107 and fastener holes 121 are possible and that the depicted number are meant for exemplary purposes only.

Figure 11:
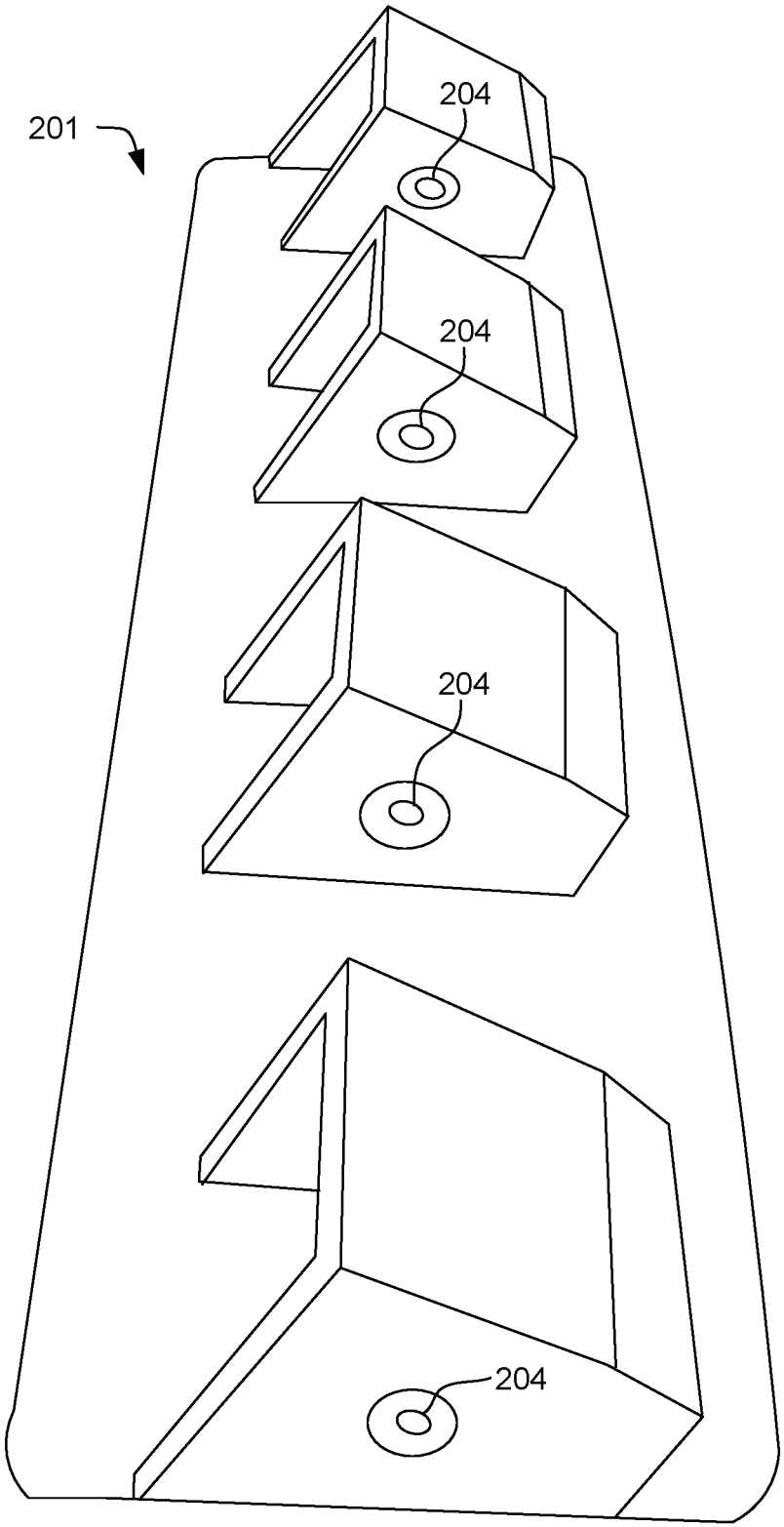
FIG. 11 is a lower perspective view of an alternative embodiment of the digging attachment device of FIG. 3.

Referring now also to FIG. 11 in the drawings, a lower perspective view of an alternative embodiment of device 101 is provided. Digging attachment device 201 is similar in form and function to device 101 in all respects except as herein identified. Device 201 is configured to include fastener holes 204, similar to fasteners holes 121, in communication with the side walls of the slots as opposed to passing through the plate. Some buckets use teeth that have teeth fasteners that are located on sides of the teeth as opposed to those seen in FIG. 1. In such embodiments, device 201 is configured to align fastener holes 204 with the side teeth fasteners similarly to that of holes 121. Fasteners 107 may be used in holes 204. Operation of fasteners 107 and holes 204 work similarly as seen in device 101.

The current application has many advantages over the prior art. The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A digging attachment device for an earth working bucket for use in digging dirt, wherein the bucket has a plurality of teeth extending forward from the bucket, the teeth are secured to the bucket by a tooth fastener, the device comprising:

a plate having a generally rectangular shape, the plate having a top surface and a lower surface, the lower surface adjacent the plurality of teeth;

a plurality of slots coupled to the lower surface of the plate, the plurality of slots configured to pass around the plurality of teeth; and a fastener configured to engage the tooth fastener within a countersunk surface of the tooth fastener so as to prevent translation of the digging attachment device off of the plurality of teeth, the fastener being aligned with the plate relative to the teeth, the fastener is in removable contact with the tooth fastener and is in communication with one of the plurality of slots.

2. The device of claim 1, wherein the top surface of the plate is rounded being thinnest around its perimeter.

3. The device of claim 1, wherein the plurality of slots define an interior volume.

4. The device of claim 3, wherein the internal volume is defined by a space between opposing side walls of the slot, a lower member of the slot, and the lower surface.

5. The device of claim 4, wherein the lower member is angled relative to the lower surface.

6. The device of claim 1, wherein the plurality of slots are angled relative to the lower surface.

7. The device of claim 1, wherein the distance between the lower surface and a lower member of the slot is shorter adjacent a front edge of the lower member than at a rear edge of the lower member.

8. The device of claim 1, wherein the plurality of slots are configured to contact the perimeter of the teeth.

9. The device of claim 1, wherein the fastener is in communication with the plate.

10. The device of claim 1, wherein the plate extends beyond a distal end of the plurality of teeth.

11. The device of claim 1, wherein the plurality of slots are set back from a front edge and rear edge of the plate.

12. The device of claim 1, wherein the plate extends beyond the plurality of teeth; wherein each of the plurality of teeth has a corresponding slot in the plurality of slots; and wherein the fastener is threaded so as to translate axially relative to an axis of the tooth fastener.

13. A method of operating a digging attachment device with an earth working bucket used in the digging of dirt, wherein the bucket has a plurality of teeth extending forward from the bucket, the teeth are secured to the bucket by a tooth fastener, wherein the tooth fastener has a countersunk surface, the method comprising:

translating the digging attachment device over the plurality of teeth, the digging attachment device having a plate and a plurality of slots;

aligning the plurality of slots with the plurality of teeth;

contacting the plurality of teeth to the plurality of slots so as to seat the plurality of slots around a perimeter of the plurality of teeth;

aligning a fastener of the digging attachment device with the tooth fastener, the fastener is in communication with one of the plurality of slots; and engaging the fastener into the countersunk surface of the tooth fastener so as to prevent translation of the digging attachment device off of the plurality of teeth.

14. The method of claim 13, wherein the plate has a top surface, the top surface of the plate is rounded being thinnest around its perimeter.

15. The method of claim 13, wherein the plurality of slots are hollowed to accept the plurality of teeth, each of the plurality of slots define an interior volume as space between opposing side walls, a lower member, and a lower surface of the plate.

16. The method of claim 15, wherein the lower member is angled relative to the lower surface.

17. The method of claim 13, wherein the fastener is in communication with the plate.

18. The method of claim 13, further comprising:

backing out the fastener from the countersunk surface; and translating the digging attachment device off the plurality of teeth.

* * * * *